US008083536B2

(12) United States Patent
Leach

(10) Patent No.: US 8,083,536 B2
(45) Date of Patent: Dec. 27, 2011

(54) CONNECTOR ASSEMBLY AND METHOD FOR SATA DRIVES

(75) Inventor: Anthony Leach, Cheshire (GB)

(73) Assignee: OCZ Technology Group Inc, San Jose, CA (US)

( * ) Notice: Subject to any disclaimer, the term of this patent is extended or adjusted under 35 U.S.C. 154(b) by 0 days.

(21) Appl. No.: 12/872,114

(22) Filed: Aug. 31, 2010

(65) Prior Publication Data

US 2011/0053429 A1 Mar. 3, 2011

Related U.S. Application Data

(60) Provisional application No. 61/238,312, filed on Aug. 31, 2009.

(51) Int. Cl.
*H01R 13/627* (2006.01)

(52) U.S. Cl. ..... 439/358; 439/607.56

(58) Field of Classification Search ..... 439/345, 439/347, 352, 353, 357, 358, 607.56
See application file for complete search history.

(56) References Cited

U.S. PATENT DOCUMENTS 4,653,836 A * 3/1987 Peele ..... 439/607.47
5,417,590 A * 5/1995 Dechelette et al. ..... 439/607.48
5,580,268 A * 12/1996 Miyazawa ..... 439/352
6,585,536 B1 * 7/2003 Wu ..... 439/358
7,081,002 B2 * 7/2006 de Vanssay et al. ..... 439/350
7,252,531 B2 * 8/2007 Wu ..... 439/358
7,261,582 B2 * 8/2007 Wu ..... 439/352
7,828,582 B2 * 11/2010 Xu et al. ..... 439/353
2006/0063415 A1 * 3/2006 de Vanssay et al. ..... 439/350
2006/0252296 A1 * 11/2006 Wu ..... 439/358
2007/0059968 A1 * 3/2007 Ohtaka et al. ..... 439/352
2009/0305547 A1 * 12/2009 Bandhu et al. ..... 439/352
2011/0053429 A1 * 3/2011 Leach ..... 439/668

* cited by examiner

*Primary Examiner* — James Harvey
(74) *Attorney, Agent, or Firm* — Hartman & Hartman, P.C.; Gary M. Hartman; Domenica N. S. Hartman

(57) ABSTRACT

A connector assembly and method suitable for making data and power connections with mass storage devices that use the SATA interface standard. The connector assembly includes a connector having a pair of oppositely-disposed surfaces, a face between the surfaces, and data and power connector portions disposed in the face. The data and power connector portions are adapted to establish data and power connections between the connector and a SATA interface of a mass storage device. The connector assembly further has data and power cables for transmitting, respectively, data and power through the data and power connector portions of the connector. Opposing clips protrude from the oppositely-disposed surfaces of the connector and project beyond the face of the connector. The clips engage opposing sides of the mass storage device and mechanically stabilize the data and power connections between the connector and the SATA interface of the mass storage device.

20 Claims, 4 Drawing Sheets

CONNECTOR ASSEMBLY AND METHOD FOR SATA DRIVES

CROSS REFERENCE TO RELATED APPLICATIONS

This application claims the benefit of U.S. Provisional Application No. 61/238,312, filed Aug. 31, 2009, the contents of which are incorporated herein by reference.

BACKGROUND OF THE INVENTION

The present invention generally relates to memory devices for use with computers and other processing apparatuses. More particularly, this invention relates to Serial ATA (advanced technology attachment), or SATA, as an interface standard for non-volatile or permanent memory-based mass storage devices.

SATA is a computer bus interface for connecting mass storage devices, for example hard disk drives (HDDs) and optical drives, to a host bus adapter (host controller) of a computer. As with prior bus interfaces, the SATA interface comprises complementary connectors (female and male) adapted to connect to each other, one connector being mounted or otherwise connected to the drive and the other connected to a data cable over which data are transmitted to and from the drive. FIG. 1 represents a conventional SATA interface 10 adapted to solely transmit data to and from a drive (not shown) through a connector 12 and data cable 14, necessitating a second connection (not shown) for supplying power to the drive. The SATA interface 10 uses a simplified connectivity scheme compared to parallel ATA. The pin configuration is a staggered contact seven-pin connector with interspersed ground or shield contacts that discharge any electrostatic charges before data lines are connected. Two pairs of data lines provide differential signaling in each direction, that is, load and store are provided in full duplex fashion. Consequently, only four connector pins are necessary to transfer the data from the data cable 14 to the drive, and vice-versa.

One of the critical issues in the design of the SATA interface has been to provide enough rigidity for the interface so that the cables are securely attached to the data and power connector. This issue is of particular importance in view of the high-speed signaling used in SATA technology, starting at 1.5 Gbps in the first generation, 3.0 Gbps in the second current generation, and heading towards 6 Gbps for the third generation. Another issue is the avoidance of damage to a drive to which a SATA interface is connected in the event that the connection is so secure that excessive stresses can be exerted through the data cable on the connector attached to the drive. Current connector-cable configurations used with SATA interface connectors of the type shown in FIG. 1 typically present a compromise between the two extremes of an excessively loose and an excessively tight connection to a drive. If too loose, the SATA connector may not be sufficiently secure to avoid inadvertent disconnections, and may also allow misalignments with the drive's connector. The result can lead to signal and potential data loss or even system damage. On the other hand, if the SATA connector is too tightly connected to the drive's connector, there is a risk that excessive mechanical stresses can damage the connector on the drive. This type of stress can occur in situations of an open case, or simply during maintenance or drive swapping in which case the drive must be disconnected from the cable. Particularly in the case of hot-swap enabled devices, that is, devices that can be inserted and removed from a computer without shutting the system down, an excessively tight connection can result in undue mechanical stress on the connector or the printed circuit board to which it is attached.

To address the above issues, SATA interfaces have been designed to allow the cable connector to disengage from the drive connector prior to the mechanical stability of the drive connector being compromised. For this purpose, several iterations of cable designs have been devised over the past that have incorporated some type of clip adapted to engage the drive connector. These designs have partially addressed the problem of wear and loose contacts, though at the risk of incurring damage to the electrical connectivity between the drive and its connector, particularly the solder connections.

A different possible approach to the above is offered by the smaller form factor of the standard 2.5-inch drive. Whereas a SATA connector that engages the housing of a 3.5-inch drive (typically about 20 mm height) would be extremely bulky, the form factor of a 2.5-inch drive typically uses a height of about 9 mm, which allows for a slim-line connector with enough sturdiness to securely engage with the drive housing without adding additional mechanical strain on the connector, including the data and power connections between the connector and the drive.

Serial Attached SCSI (SAS) is another type of computer bus used to move data between computer mass storage devices, including hard drives and tape drives. FIG. 2 represents a SAS interface 20 that combines power and data connections in a single connector 22. The connector 22 has a conventional SAS form factor. Data and power cables 24 and 26 are separately coupled to the SAS connector 22 for transmitting both data and power to a drive through separate portions 28 and 30 of the connector 22 containing, respectively, data and power pins (not shown). The additional size and weight of the SAS connector 22 relative to the SATA connector 12 of FIG. 1 exacerbate the problems and compromises discussed above as being associated with SATA connectors.

BRIEF DESCRIPTION OF THE INVENTION

The present invention provides a connector assembly and method suitable for making data and power connections with mass storage devices that use the SATA interface standard.

According to a first aspect of the invention, the connector assembly includes a connector having a cross-section defining a pair of oppositely-disposed surfaces that are spaced apart by a minor dimension of the cross-section. The connector further has a face between the surfaces and data and power connector portions disposed in the face. The data and power connector portions are adapted to establish data and power connections between the connector and a SATA interface of a mass storage device. The connector assembly further has at least one data cable for transmitting data through the data connector portion of the connector, and at least one power cable for transmitting power to the power connector portion of the connector. Opposing clips protrude from the oppositely-disposed surfaces of the connector and project beyond the face of the connector. The clips are adapted to engage opposing sides of the mass storage device and mechanically stabilize the data and power connections between the connector and the SATA interface of the mass storage device.

Additional aspects of the invention include assemblies formed by assembling the connector with the SATA interface of the mass storage device described above, as well as methods of assembling the connector with the SATA interface of the mass storage device described above.

According to another aspect of the invention, a method is provided that entails connecting a SATA interface of a mass storage device to a host bus adapter for transmitting data between the mass storage device and the host bus adapter and supplying power to the mass storage device. The method entails the use of a connector assembly comprising a connector having a pair of oppositely-disposed surfaces, a face between the surfaces, and data and power connector portions disposed in the face. The method further entails assembling the connector assembly with the mass storage device to establish data and power connections between the connector and the SATA interface of the mass storage device through the data and power connector portions of the connector. The assembling step causes opposing sides of the mass storage device to be engaged by opposing clips protruding from the oppositely-disposed surfaces of the connector to mechanically stabilize the data and power connections between the connector and the SATA interface.

According to a preferred aspect of the invention, the connector assembly is able to provide improved mechanical stability that enables more reliable contact alignment and protection against unwanted disconnects, while simultaneously relieving the stress from the drive connector by mechanically engaging the drive's enclosure. Data and power portions of the connector are integrated into a single assembly, and separate cables are preferably provided to connect to standard data interfaces as they are common on current computer motherboards, as well as connect to a power source as provided by commonly used computer power supply units.

Other objects and advantages of this invention will be better appreciated from the following detailed description.

DETAILED DESCRIPTION OF THE INVENTION

FIGS. 3 through 6 represent SATA connectors of this invention that are particularly well suited for connection to hard disk drives (HDDs) and solid state drives (SSDs) of various types known in the art, including mass storage devices utilizing flash nonvolatile memory devices such as NAND chips, though the use of other memory technologies is also within the scope of the invention. Accordingly, the term "drive" will be used herein for convenience, though it should be understood that the invention is not limited to traditional mass storage devices having a standard "drive" form factor, but instead encompasses various types of mass storage devices.

Figure 1:
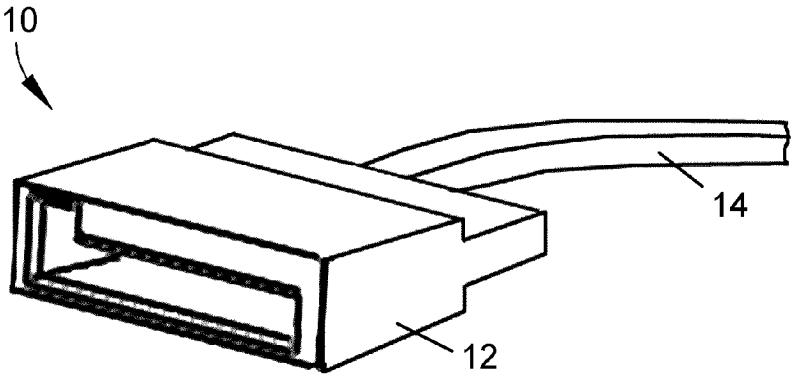
FIG. 1 (Prior Art)
FIG. 1 is a schematic representation of a conventional SATA data connector of the prior art.
Figure 2:
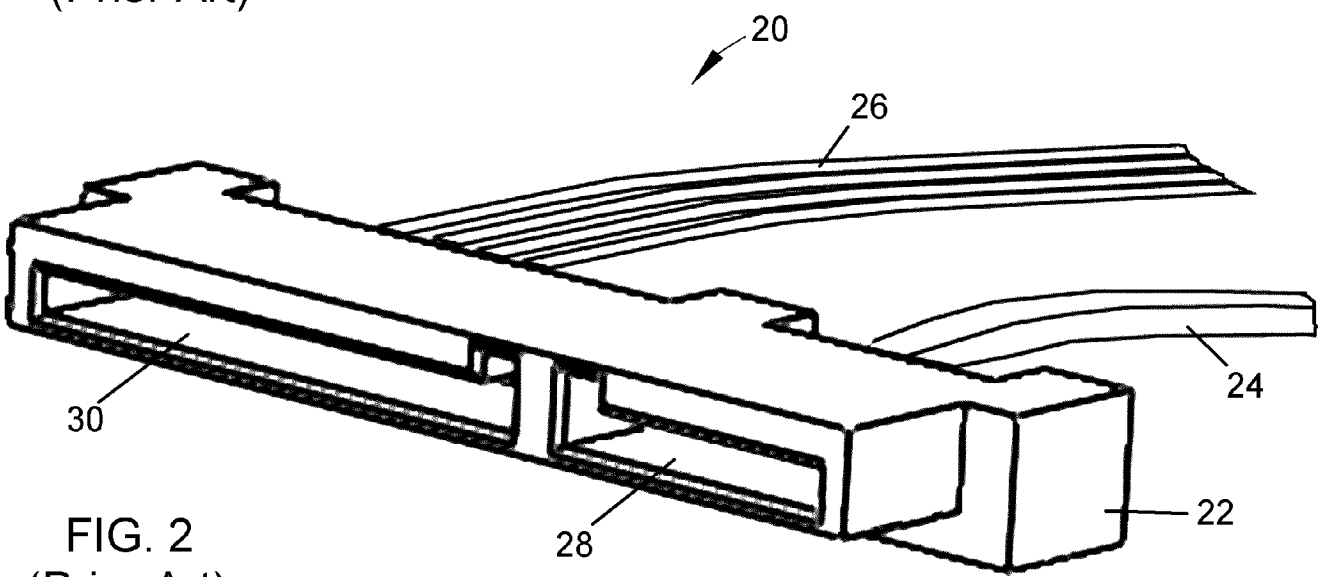
FIG. 2 (Prior Art)
FIG. 2 is a schematic representation of a combined power and data connector having a conventional SAS connector form factor.

Preferred SATA connectors of this invention are similar to the prior art SAS connector of FIG. 2 in terms of incorporating both data and power connections within a single connector. The current invention addresses problems associated with excessively loose and excessively tight connections to a drive by allowing the data and power connectors to engage and disengage with relative ease, though at the same time in a manner that establishes a secondary mechanical connectivity with the enclosure of the drive to which the SATA connector is to be connected.

Figure 3:
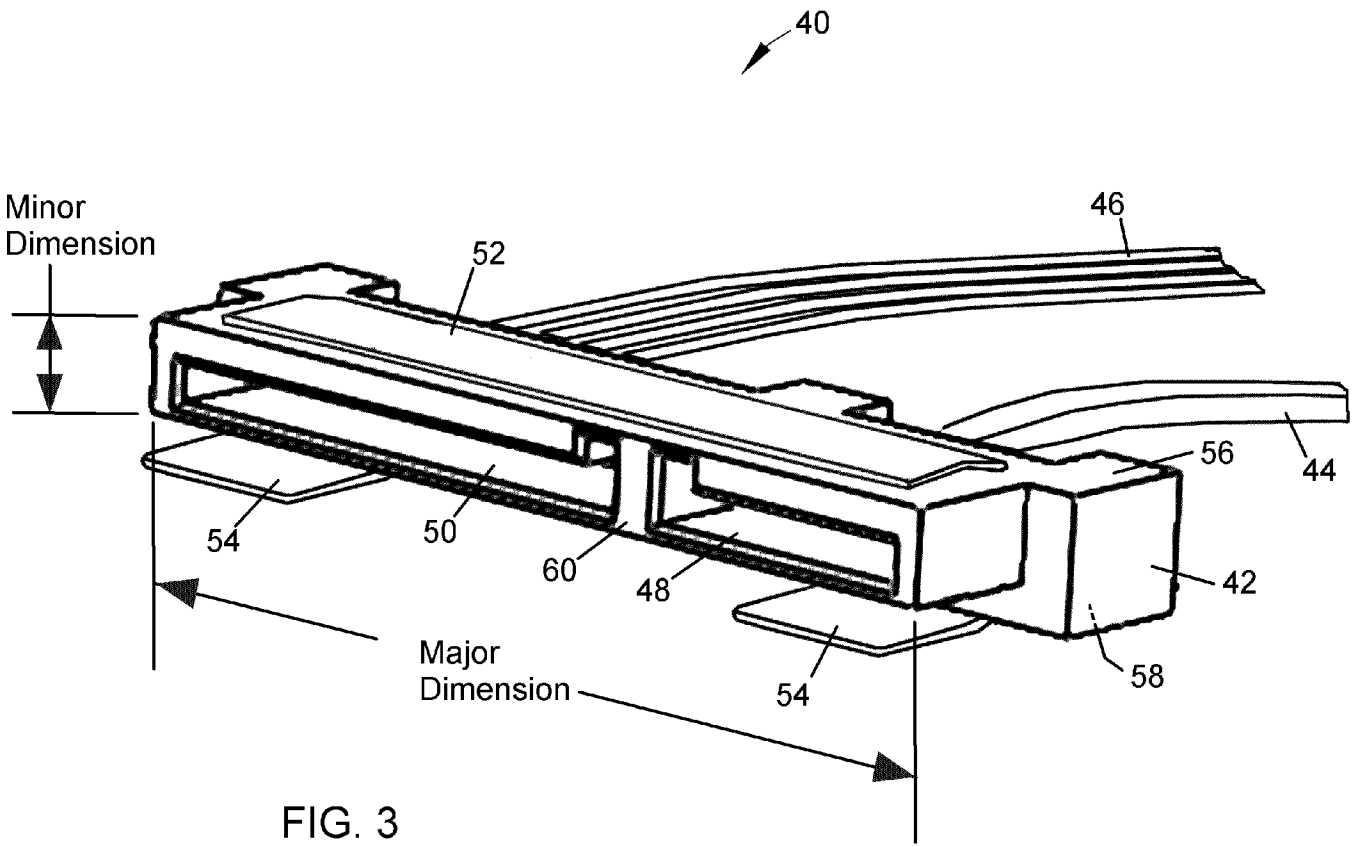
FIG. 3 is a perspective view representing a connector equipped with retention clips in accordance with a first embodiment of the invention.

In a first embodiment represented in FIG. 3, a SATA interface 40 is represented as comprising a connector 42 to which data and power cables 44 and 46 are separately coupled for transmitting both data and power to a drive through separate portions 48 and 50 of the connector 42 that contain, respectively, data and power pins (not shown). The connector portions 48 and 50 are shown as female connectors for connecting to complementary male connectors mounted on an enclosure of a drive (not shown) to which the connector 42 is to be coupled. Because details regarding suitable geometries, pin counts, and other aspects of the connector portions 48 and 50 are well known, they will not be discussed here in any detail.

As evident from FIG. 3, the connector 42 has a generally rectangular cross-section, such that relatively larger surfaces 56 and 58 of the connector 42 (in other words, the surfaces that define the major (largest) dimension of the cross-section) are oppositely disposed from each other and spaced apart by a minor dimension of the rectangular cross-section (in other words, the smaller of the two dimensions of the rectangular cross-section). Though a rectangular cross-section is shown and common, it will become appreciated from the following discussion that cross-sections of various geometric shapes are also within the scope of the invention to the extent that they define relatively large opposing surfaces similar to the surfaces 56 and 58 depicted in the Figures. The connector 42 is equipped with retention clips 52 and 54 that are adapted for engaging a drive enclosure, as opposed to the SATA interface of the drive. The clips 52 and 54 project from the oppositely-disposed surfaces 56 and 58 of the connector 42 and extend toward a face 60 of the connector 42 that is between and represented as perpendicular to the surfaces 56 and 58. The connector portions 48 and 50 of the connector 42 are disposed in the face 60. The clip 52 is represented as a single prong that extends along nearly the entire width of the connector surface 56, while the opposing clips 54 are represented as a pair of prongs disposed at oppositely disposed ends of the connector 42 in the direction of its larger dimension. While the configuration shown in FIG. 3 is believed to be preferred, it is foreseeable that the positions of the clips 52 and 54 could be reversed, and any number of each type of clip 52 and 54 could be employed. The clips 52 and 54 can be integrally molded with the body of the connector 42, or can be separately formed and attached to the surfaces 56 and 58 of the connector 42.

Figure 4:
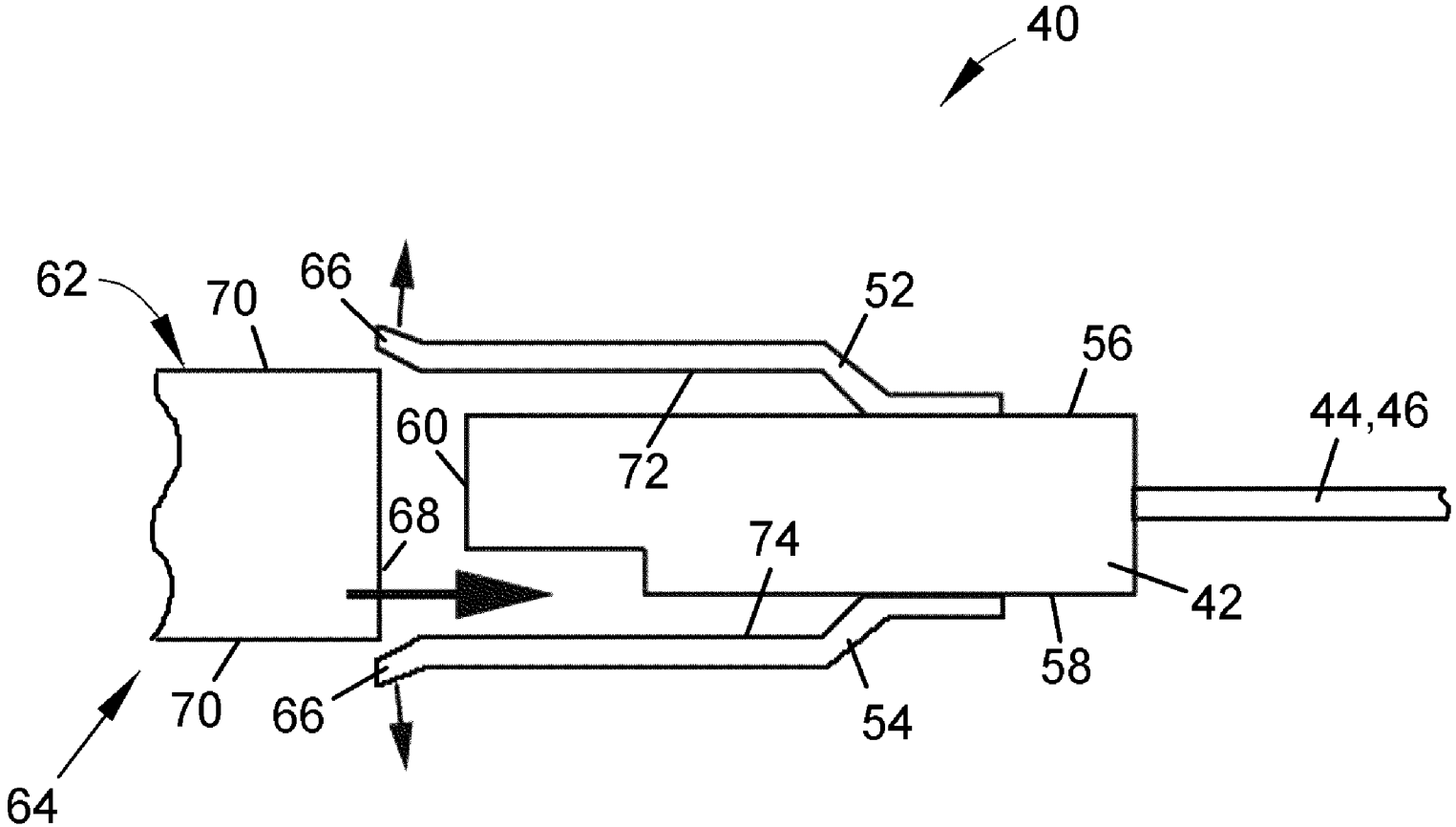
FIG. 4 is a cross-sectional side view showing retention clips similar to that shown in FIG. 3, but modified to have beveled edges to facilitate engagement of the connector with an enclosure of a drive in accordance with a second embodiment of the invention.
Figure 5:
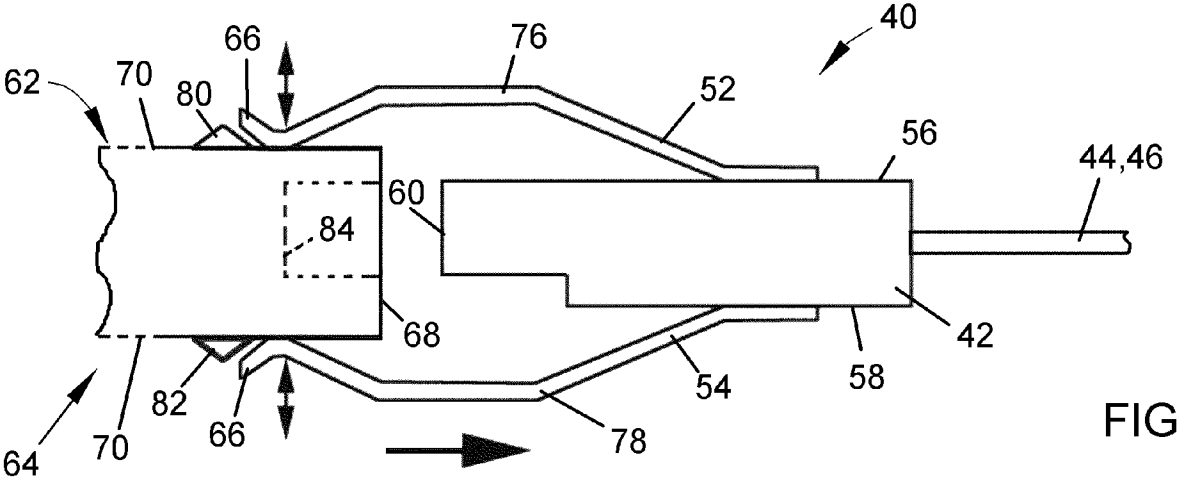
FIGS. 5 and 6 are cross-sectional side views showing retention clips similar to FIG. 3, but modified to engage raised features on an enclosure of a hard disk drive (HDD) or solid state drive (SSD) in accordance with a third embodiment of the invention.
Figure 6:
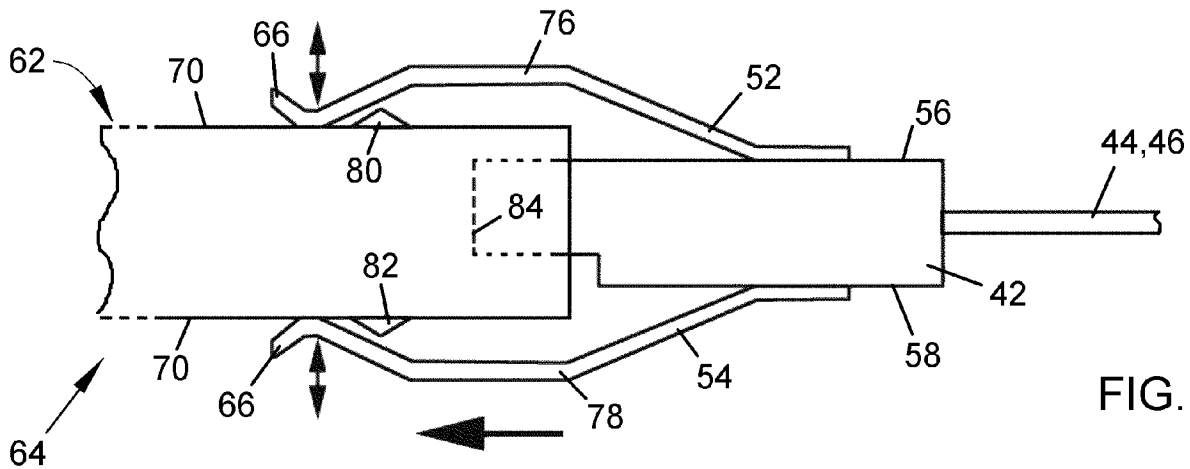

The clips 52 and 54 shown in FIG. 3 are spaced apart and configured to slide over the exterior of an enclosure of drive, for example, a 2.5-inch HDD or SSD. Such an installation is represented in FIG. 4, which shows the clips 52 and 54 engaging opposite surfaces of an enclosure 62 of a drive 64. The embodiment of FIG. 4 differs slightly from that of FIG. 3 as a result of the distal end 66 of each clip 52 and 54 being slightly beveled away from the center of the connector 42 to ensure that the clips 52 and 54 are resiliently deflected outward away from the front face 68 of the drive enclosure 62 in which a complementary connector (not shown) is provided for connection with the connector 42. In particular, the clips 52 and 54 are sized and shaped so that their respective distal ends 66 will initially engage corners of the enclosure 62 on either side of the enclosure's front face 68, and as a result expand outward to have a spring-loaded interference fit with opposing sides 70 of the drive enclosure 62. As a result, the clips 52 and 54 clamp onto the drive enclosure 62, which serves to increase the rigidity of the mechanical connection between the connector 42 and drive enclosure 62, as well as help maintain the alignment of all contacts of the connector 42 by inhibiting movement of the connector 42 relative to the enclosure 62 that could lead to increased wear.

In FIGS. 3 and 4, the bulk of each clip 52 and 54 is essentially parallel to the surface 56 or 58 from which it extends and the clips 52 and 54 are slightly closer together than the thickness of the drive enclosure 62 between its opposing sides 70, such that facing surfaces 72 and 74 of the clips 52 and 54 are able to have a generally surface-to-surface contact with the opposing sides 70 of the enclosure 62. In another embodiment represented in FIGS. 5 and 6, the clips 52 and 54 are further modified to have a roughly S-shaped cross-section, with portions 76 and 78 of the clips 52 and 54 between their respective ends 66 and their respective junctions with the surface 56 or 58 projecting away from each other, so as not to engage or contact the opposing sides 70 of the enclosure 62. Instead, retention is entirely based on the ends 66 of the clips 52 and 54 engaging raised features 80 and 82 disposed on the opposing sides 70 of the drive enclosure 62. As the connector 42 is being engaged with the complementary connector 84 in the front face 68 of the enclosure 62, the ends of the clips 52 and 54 travel along the sides 70 of the enclosure 62 until they encounter the raised features 80 and 82, which force the ends 66 of the clips 52 and 54 apart. As the ends 66 of the clips 52 and 54 travel past the raised features 80 and 82, the ends 66 are permitted to resume contact with the sides 70 of the enclosure 62, and the raised features 80 and 82 serve to retain the connector 42 on the enclosure 62 and, therefore, maintain the electrical connection between the connector 42 and the complementary connector 84 of the enclosure 62.

While certain components are shown and preferred for the connector assemblies of this invention, it is foreseeable that functionally-equivalent components could be used or subsequently developed to perform the intended functions of the disclosed components. Therefore, while the invention has been described in terms of particular embodiments, it is apparent that other forms could be adopted by one skilled in the art. Finally, while the appended claims recite certain aspects believed to be associated with the invention and indicated by the investigations discussed above, they do not necessarily serve as limitations to the scope of the invention.

The invention claimed is:

1. A connector assembly configured to connect a SATA interface provided in an enclosure of a mass storage device to a host bus adapter, transmit data between the mass storage device and the host bus adapter, and supply power to the mass storage device, the connector assembly comprising:

a connector having a cross-section defining a pair of oppositely-disposed surfaces that are spaced apart by a minor dimension of the cross-section, the connector further having a face between the surfaces, and data and power connector portions disposed in the face, the data and power connector portions being adapted to establish data and power connections between the connector and the SATA interface of the mass storage device;

at least one data cable for transmitting data through the data connector portion of the connector;

at least one power cable for transmitting power to the power connector portion of the connector; and opposing clips protruding from the oppositely-disposed surfaces of the connector and projecting beyond the face of the connector, the clips being adapted to engage opposite exterior surfaces of the enclosure of the mass storage device as opposed to the SATA interface of the mass storage device, and mechanically stabilize the data and power connections between the connector and the SATA interface of the mass storage device.

2. The connector assembly of claim 1, wherein the oppositely-disposed surfaces define a major dimension of the cross-section.

3. The connector assembly of claim 1, wherein at least two of the clips comprise facing surfaces adapted to make surface-to-surface contact with the opposite exterior surfaces of the enclosure of the mass storage device.

4. The connector assembly of claim 3, wherein the at least two clips comprise distal ends that are beveled away from a center of the connector between the facing surfaces.

5. The connector assembly of claim 3, wherein the connector assembly is assembled with the mass storage device and the data and power connections are established between the connector and the SATA interface and are mechanically stabilized by the clips.

6. An assembly defined by the connector assembly and the mass storage device of claim 5.

7. A method comprising assembling the connector assembly of claim 3 with the mass storage device to establish the data and power connections between the connector and the SATA interface and to mechanically stabilize the data and power connections by engaging the facing surfaces of the clips with the opposite exterior surfaces of the enclosure of the mass storage device so as to make surface-to-surface contact therebetween.

8. The connector assembly of claim 1, wherein at least two of the clips comprise distal ends configured for engaging the opposite exterior surfaces of the enclosure of the mass storage device.

9. The connector assembly of claim 8, wherein the at least two clips comprise portions between the respective distal ends thereof and respective junctions with the oppositely-disposed surfaces of the connector, and the portions project away from each other so as not to be adapted to engage or contact the opposite exterior surfaces of the enclosure of the mass storage device.

10. The connector assembly of claim 9, wherein the at least two clips have S-shaped cross-sections.

11. The connector assembly of claim 9, wherein the connector assembly is assembled with the mass storage device and the data and power connections are established between the connector and the SATA interface and are mechanically stabilized by the clips.

12. The connector assembly of claim 11, wherein the distal ends of the at least two clips engage raised features on the opposite exterior surfaces of the enclosure of the mass storage device.

13. An assembly defined by the connector assembly and the mass storage device of claim 8.

14. A method comprising assembling the connector assembly of claim 8 with the mass storage device to establish the data and power connections between the connector and the SATA interface and to mechanically stabilize the data and power connections by engaging the distal ends of the clips with the opposite exterior surfaces of the enclosure of the mass storage device.

15. A method comprising assembling the connector assembly of claim 8 with the mass storage device to establish the data and power connections between the connector and the SATA interface and to mechanically stabilize the data and power connections by engaging the distal ends of the clips with raised features on the opposite exterior surfaces of the enclosure of the mass storage device.

16. A method of connecting a SATA interface provided in an enclosure of a mass storage device to a host bus adapter for transmitting data between the mass storage device and the host bus adapter and supplying power to the mass storage device, the method comprising:

providing a connector assembly comprising a connector having a pair of oppositely-disposed surfaces, a face between the surfaces, and data and power connector portions disposed in the face; and assembling the connector assembly with the mass storage device to establish data and power connections between the connector and the SATA interface of the mass storage device through the data and power connector portions of the connector, the assembling step causing opposite exterior surfaces of the enclosure of the mass storage device, as opposed to the SATA interface of the mass storage device, to be engaged by opposing clips protruding from the oppositely-disposed surfaces of the connector to mechanically stabilize the data and power connections between the connector and the SATA interface.

17. The method of claim 16, wherein the assembling step causes the clips to resiliently deflect outward as the clips engage the opposite exterior surfaces of the enclosure of the mass storage device.

18. The method of claim 16, wherein the assembling step further comprises engaging facing surfaces of the clips with the opposite exterior surfaces of the enclosure of the mass storage device so as to make surface-to-surface contact therebetween.

19. The method of claim 16, wherein the assembling step further comprises engaging the distal ends of the clips with the opposite exterior surfaces of the enclosure of the mass storage device.

20. The method of claim 16, wherein the assembling step further comprises engaging the distal ends of the clips with raised features on the opposite exterior surfaces of the enclosure of the mass storage device.

* * * * *